US008079672B2

(12) United States Patent
Guan et al.

(10) Patent No.: US 8,079,672 B2
(45) Date of Patent: Dec. 20, 2011

(54) HEATER STACK AND METHOD FOR MAKING HEATER STACK WITH CAVITY BETWEEN HEATER ELEMENT AND SUBSTRATE

(75) Inventors: Yimin Guan, Lexington, KY (US); Burton Lee Joyner, II, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 368 days.

(21) Appl. No.: 12/265,162

(22) Filed: Nov. 5, 2008

(65) Prior Publication Data

US 2010/0110146 A1 May 6, 2010

(51) Int. Cl.
*B41J 2/05* (2006.01)

(52) U.S. Cl. ..... 347/63

(58) Field of Classification Search ..... None
See application file for complete search history.

(56) References Cited

U.S. PATENT DOCUMENTS

| | | | | |
|---|---|---|---|---|
| 7,195,343 | B2 | 3/2007 | Anderson et al. | |
| 7,449,280 | B2 * | 11/2008 | Johnson et al. | 430/280.1 |
| 2006/0103694 | A1 * | 5/2006 | Nguyen | 347/47 |
| 2009/0315951 | A1 * | 12/2009 | Lebens et al. | 347/63 |

OTHER PUBLICATIONS

Wikipedia Article—Polyimide, retrieved online Feb. 18, 2011, section titled Applications.*

* cited by examiner

*Primary Examiner* — Matthew Luu
*Assistant Examiner* — Lisa Solomon

(57) ABSTRACT

A heater stack includes first strata configured to support and form a fluid heater element responsive to repetitive electrical activation and deactivation to produce repetitive cycles of fluid ejection from an ejection chamber above the heater element and second strata overlying the first strata and contiguous with the ejection chamber to protect the heater element. The first strata includes a substrate with a cavity formed either in or above the substrate, a heater substrata overlying the cavity and substrate, and a decomposed layer of material between the substrate and heater substrata and processed to provide the cavity substantially empty of the layer of material such that the cavity provides a means which, during repetitive electrical activation, enables the heater element to transfer heat energy into the fluid in the ejection chamber for producing ejection of fluid therefrom substantially without transferring heat energy into the substrate.

8 Claims, 3 Drawing Sheets

HEATER STACK AND METHOD FOR MAKING HEATER STACK WITH CAVITY BETWEEN HEATER ELEMENT AND SUBSTRATE

BACKGROUND

1. Field of the Invention

The present invention relates generally to micro-fluid ejection devices and, more particularly, to a heater stack of a micro-fluid ejection device and a method for making the heater stack with a cavity between the heater element and the substrate.

2. Description of the Related Art

Micro-fluid ejection devices have had many uses for a number of years. A common use is in a thermal inkjet printhead in the form of a heater chip. In addition to the heater chip, the inkjet printhead basically includes a source of supply of ink, a nozzle plate attached to or integrated with the heater chip, and an input/output connector, such as a tape automated bond (TAB) circuit, for electrically connecting the heater chip to a printer during use. The heater chip is made up of a plurality of resistive heater elements, each being part of a heater stack. The term "heater stack" generally refers to the structure associated with the thickness of the heater chip that includes first, or heater forming, strata made up of resistive and conductive materials in the form of layers or films on a substrate of silicon or the like and second, or protective, strata made up of passivation and cavitation materials in the form of layers or films on the first strata, all fabricated by well-known processes of deposition, patterning and etching upon the substrate of silicon. The heater stack also has one or more fluid vias or slots that are cut or etched through the thickness of the silicon substrate and the first and second strata, using these well-known processes, serve to fluidly connect the supply of ink to the heater stacks. A heater stack having this general construction is disclosed as prior art in U.S. Pat. No. 7,195,343, which patent is assigned to the same assignee as the present invention. The disclosure of this patent is hereby incorporated by reference herein.

Despite their seeming simplicity, construction of heater stacks requires consideration of many interrelated factors for proper functioning. The current trend for inkjet printing technology (and micro-fluid ejection devices generally) is toward lower jetting energy, greater ejection frequency, and in the case of printing, higher print speeds. A minimum quantity of thermal energy must be present on an external surface of the heater stack, above a resistive heater element therein, in order to vaporize the ink inside an ink chamber between the heater stack external surface and a nozzle in the nozzle plate so that the ink will vaporize and escape or jet through the nozzle in a well-known manner.

During inkjet heater chip operation, some of the heating energy is wasted due to heating up the "heater overcoat", or the second strata, and also heating up the substrate. Since heating or jetting energy required is proportional to the volume of material of the heater stack that is heated during an ejection sequence, reducing the heater overcoat thickness, as proposed in U.S. Pat. No. 7,195,343 is one approach to reducing the jetting energy required. However, as the overcoat thickness is reduced, corrosion of the ejectors or heater elements becomes more of a factor with regard to ejection performance and quality.

SUMMARY OF THE INVENTION

The present invention meets some or all of the foregoing described needs by providing an innovation which involves only a small degree of change or modification to the heater stack in its first strata structure and to the currently-employed fabricating processes and which basically is compatible therewith and minimizes any additional costs. Underlying certain embodiments of the present invention is an insight by the inventors herein that performance of the heater stack could be enhanced in terms of attainment of improved thermal efficiency by incorporating a cavity below the fluid heater element and either above or in the underlying substrate of the heater stack. One benefit of the cavity to the heater stack structure is that it minimizes heat transfer loss from the fluid heater element to the substrate.

Accordingly, in an aspect of the present invention, a heater stack for a micro-fluid ejection device includes first strata configured to support and form a fluid heater element responsive to repetitive electrical activation and deactivation to produce repetitive cycles of fluid ejection from an ejection chamber above the fluid heater element, and second strata overlying the first strata and contiguous with the ejection chamber to provide protection of the fluid heater element from adverse effects of the repetitive cycles of fluid ejection and of the fluid in the ejection chamber. The first strata includes a substrate with a cavity formed either in or above the substrate, heater substrata overlying the cavity and substrate, and a decomposed sacrificial layer of material deposed between the substrate and heater substrata and processed to provide the cavity substantially empty of the sacrificial layer of material such that the cavity provides a means which during repetitive electrical activation enables the fluid heater element to transfer heat energy into the fluid in the ejection chamber for producing fluid ejection therefrom substantially without transferring heat energy into the substrate.

In another aspect of the present invention, a method for making a heater stack includes processing one sequence of materials to produce first strata having a fluid heater element supported and formed on a substrate, responsive to repetitive electrical activation and deactivation to produce repetitive cycles of ejection of a fluid from an ejection chamber above the fluid heater element, and to define a cavity below the fluid heater element and either in or above the substrate, processing another sequence of materials to produce second strata overlying the first strata and contiguous with the ejection chamber to provide protection of the fluid heater element from adverse effects of the repetitive cycles of fluid ejection and of the fluid in the ejection chamber, and processing the first strata to produce the cavity defined below the fluid element heater by decomposing a sacrificial material so as to substantially empty the cavity of the sacrificial material such that the cavity provides a means which during repetitive electrical activation enables the fluid heater element to transfer heat energy into the fluid in the ejection chamber for producing ejection of the fluid therefrom substantially without transferring heat energy into the substrate.

BRIEF DESCRIPTION OF THE DRAWINGS

Figure 1:
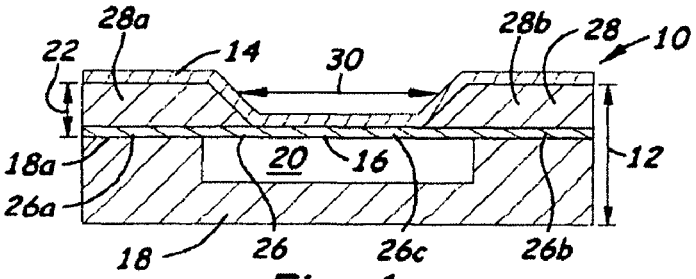

Having thus described the invention in general terms, reference will now be made to the accompanying drawings, which are not necessarily drawn to scale, and wherein:

FIG. 1 is a cross-sectional schematic representation, not to scale, of a first exemplary embodiment of a heater stack of a micro-fluid ejection device in accordance with the present invention.

Figure 2:
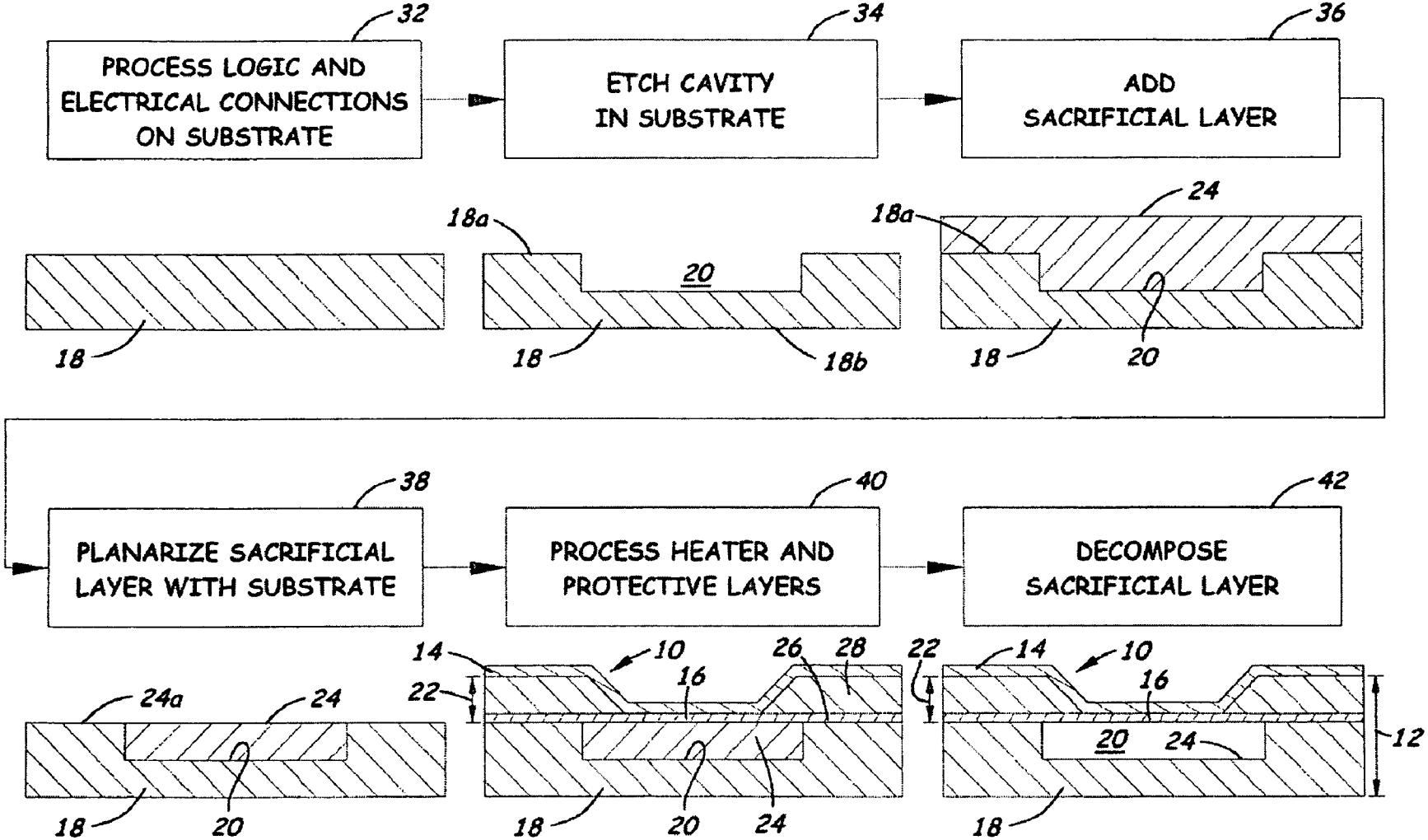

FIG. 2 is a flow diagram with accompanying schematic representations, not to scale, of a first sequence of stages in making the first exemplary embodiment of the heater stack of FIG. 1.

Figure 3:
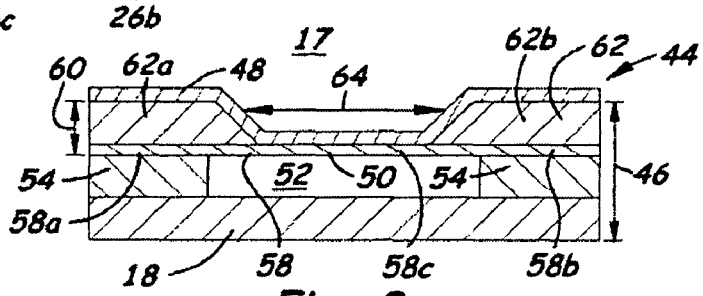

FIG. 3 is a cross-sectional schematic representation, not to scale, of a second exemplary embodiment of a heater stack of a micro-fluid ejection device in accordance with the present invention.

Figure 4:
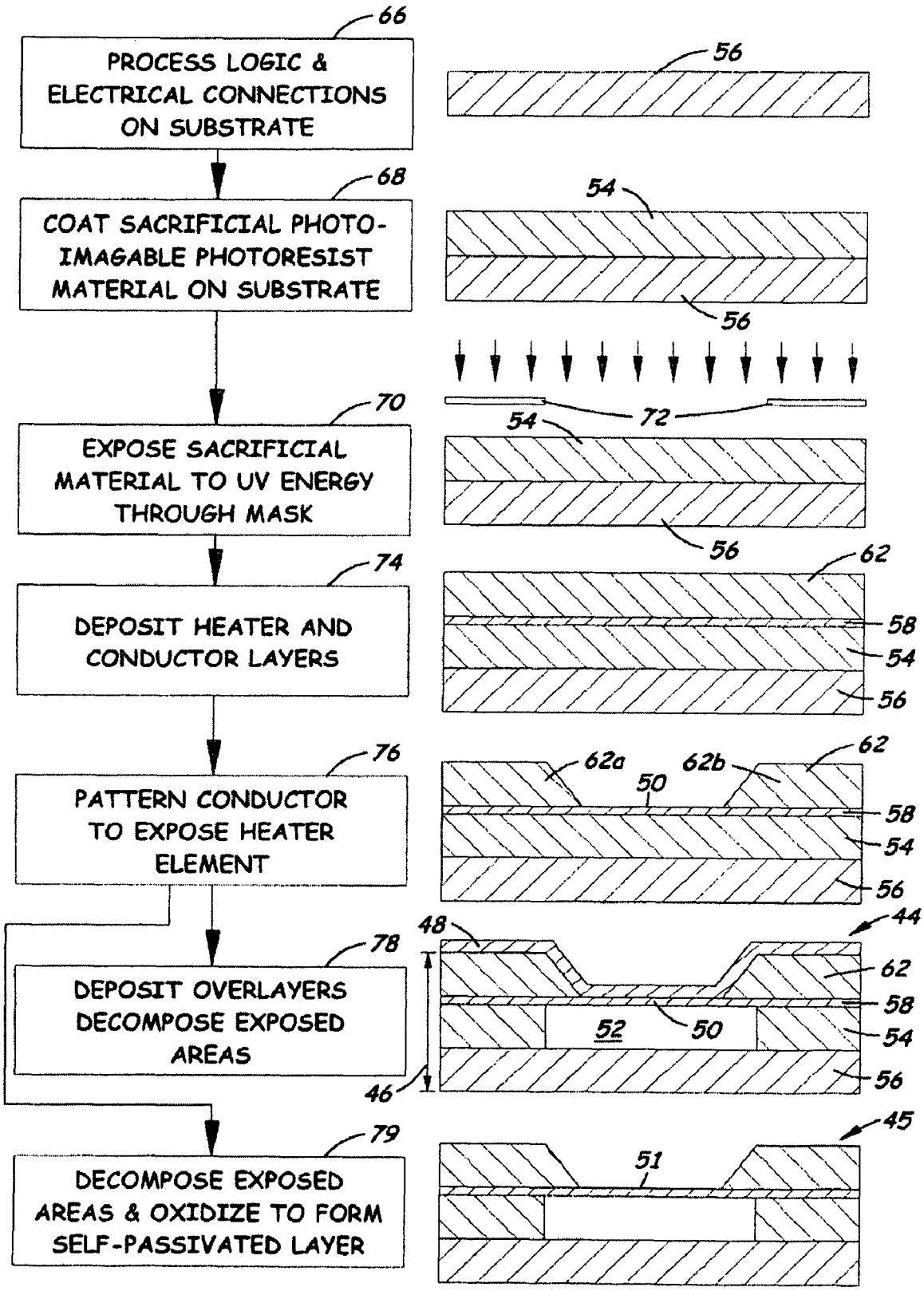

FIG. 4 is a flow diagram with accompanying schematic representations, not to scale, of a second sequence of stages in making the second exemplary embodiment of the heater stack of FIG. 3.

Figure 5:
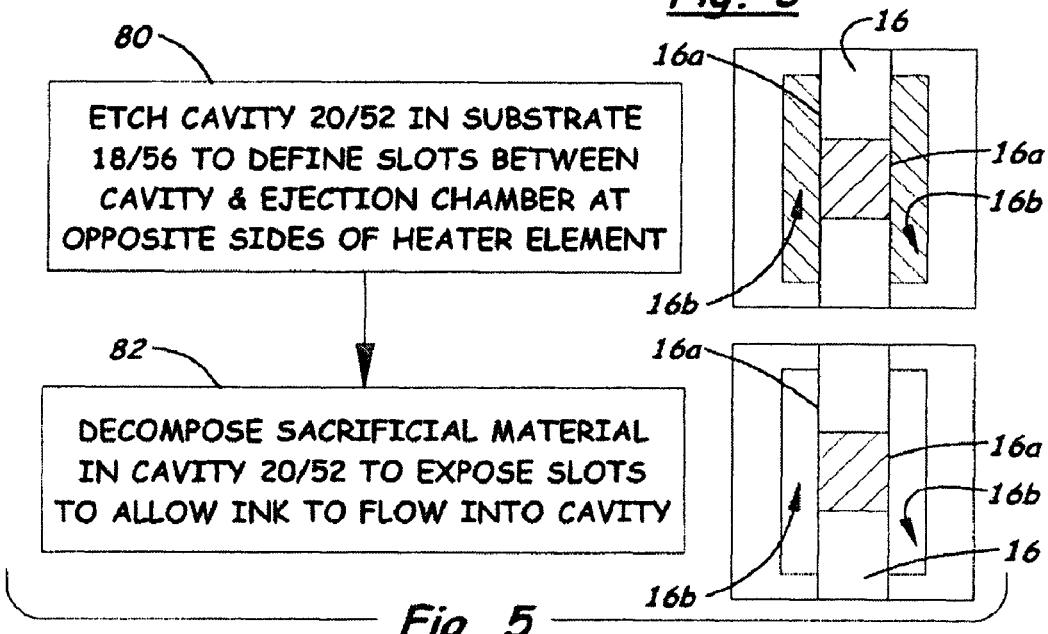

FIG. 5 is a flow diagram with accompanying schematic representations, not to scale, of a sequence of the stages, constituting modifications of certain ones of the stages of either the first or second sequences in FIG. 2 or 4, in making a third exemplary embodiment of a heater stack of a micro-fluid ejection device in accordance with the present invention.

Figure 6:
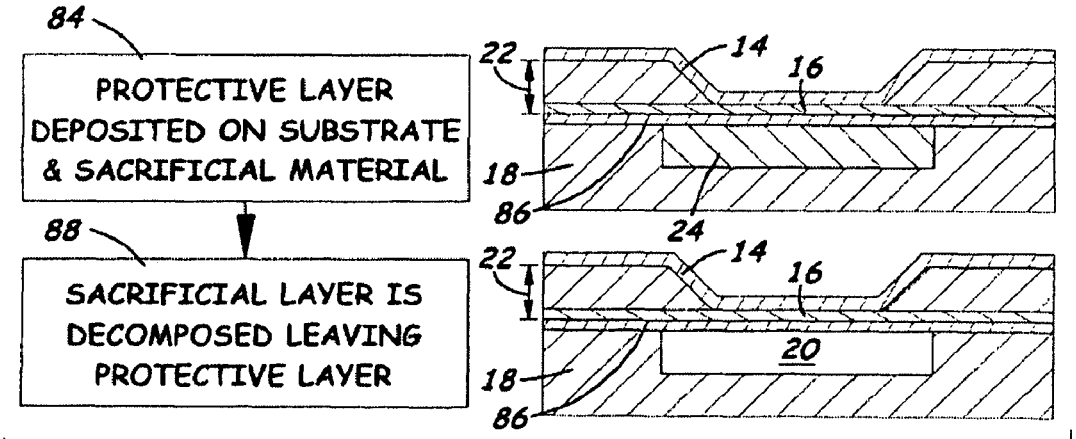

FIG. 6 is a flow diagram with accompanying schematic representations, not to scale, of an additional sequence of the stages in making a slight modification to the third exemplary embodiment of the heater stack of FIG. 5.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Also, the present invention applies to any micro-fluid ejection device, not just to heater stacks for thermal inkjet printheads. While the embodiments of the present invention will be described in terms of a thermal inkjet printhead, one of ordinary skill will recognize that the invention can be applied to any micro-fluid ejection system.

Referring now to FIG. 1, there is illustrated a first exemplary embodiment of a heater stack, generally designated 10, of a micro-fluid ejection device in accordance with the present invention. The heater stack 10 basically includes first (or heater forming) strata, generally designated 12, and second (or protective) strata, generally designated 14. The first strata 12 are configured to support and form a fluid heater element 16 in the heater stack 10 that is responsive to repetitive electrical activation and deactivation to produce repetitive cycles of fluid ejection from the ejection device. The second strata 14 overlie the first strata 12, are contiguous with an fluid ejection chamber 17 above the second strata 14 and are configured to protect the heater element 16 from well-known adverse effects of the repetitive cycles of fluid ejection from the ejection chamber 17.

More particularly, the first strata 12 of the heater stack 10 includes a substrate 18 with a cavity 20 formed in the substrate 18 and open at an upper or front surface 18*a* thereof, a heater substrata, generally designated 22, overlying the cavity 20 and front surface 18*a* of the substrate 18, and a decomposed layer of a predetermined sacrificial material 24, such as a suitable preselected polymer, deposed between the substrate 18 and the heater substrata 22 and processed to provide the cavity 20 substantially empty of the sacrificial material 24. The cavity 20 is substantially gas-filled and thus provides an insulative means which during repetitive electrical activation enables the fluid heater element 16 to transfer heat energy into the fluid, such as ink, in the ejection chamber 17 located above the heater element 16 for producing ejection of the fluid therefrom, substantially without transferring heat energy into the substrate 18.

The substrate 18 is typically made from a wafer of silicon or the like and may have at its front surface 18*a* a thermal barrier layer thereon (not shown) to reduce any heat being thermally conducted to the substrate 18 from the heater substrata 22 during the repetitive cycles of fluid ejection. The heater substrata 22 includes a resistor or resistive film or layer 26 overlying the sacrificial material 24 and an electrical conductor film or layer 28 partially overlying the resistive layer 26. The conductor layer 28 has a space 30 defined therein separating the conductor layer 28 into an anode portion 28*a* and a cathode portion 28*b* which overlie corresponding spaced apart lateral portions 26*a*, 26*b* of the resistive layer 26. The latter are interconnected and separated by a central portion 26*c* of the resistive layer 26 deposed under and co-extensive with the space 30 of the conductor layer 28. The anode and cathode portions 28*a*, 28*b* of the conductor layer 28, being positive and negative terminals of ground and power leads electrically connected to a tab circuit (not shown), cooperate with the central portion 26*c* of the resistive layer 26 to form the fluid heater element 16 of the heater substrata 22 of the first strata 12. By way of example and not of limitation, the various layers of the first strata 12 can be made of the various materials and have the ranges of thicknesses as set forth in above cited U.S. Pat. No. 7,195,343.

The second strata 14 of the heater stack 10 overlie the first strata 12 and more particularly the heater substrata 22 of the first strata 12 to protect the resistive fluid heater element 16 from the well-known adverse effects of fluid forces generated by the repetitive cycles of fluid ejection from the ejection chamber 17 above the second strata 14. Although only shown as a single layer in FIG. 1, the second strata 14 typically include at least two layers, a passivation (protective) layer and a cavitation (protective) layer. The function of the passivation layer is primarily to protect the resistive and conductor layers 26, 28 of the first strata 12 from fluid corrosion. The function of the cavitation layer is to provide protection to the fluid heater element 16 during fluid ejection operation which would cause mechanical damage to the heater stack 10 in the absence of the cavitation layer. By way of example and not of limitation, the various layers of the second strata 14 also can be made of the various materials and have the ranges of thicknesses as set forth in above cited U.S. Pat. No. 7,195,343.

Turning now to FIG. 2, there is illustrated a block flow diagram with accompanying schematic representations, not to scale, of a first sequence of stages carried out in making, or building the layers of, the first exemplary embodiment of the heater stack 10 of FIG. 1 in accordance with a method of the present invention. As per block 32, the substrate 18 in the first strata 12 is a base layer of silicon upon which the necessary logic and electrical connections have been processed and upon which all the other layers of the first and second strata 12, 14 will be deposited and patterned by using selected ones of conventional thin film integrated circuit processing techniques including layer growth, chemical vapor deposition, photo resist deposition, masking, developing, etching and the like. Next, as per block 34, the cavity 20 is etched in the substrate 18 from its front surface 18*a* for a given depth toward the rear surface 18*b*.

Following next, as per block 36, the layer of sacrificial material 24 is deposited (spun or coated) upon the front surface 18*a* of the substrate 18, filling the cavity 20. The sacrificial material 24 can be a suitable preselected polymer, a chemical vapor deposited (CVD) carbon, a diamond like carbon (DLC) deposition or the like. For a polymer to be suitable for use as the sacrificial 24, it should be compatible to current CMOS processing conditions, i.e., its decomposition temperature should be below 450° C. However, it should also maintain its structural integrity during the heater deposition step at approximately 150° C. Under the current thermal processing conditions, preselected polymers that may be used are polymethylmethacrylate (PMMA), polybutylene terephthalate (PBT), polycarbonate, or polynorbornene. Different thermal processing conditions may lead to different polymer choices. The process flow is the same with use of CVD carbon instead of polymer. Then, as per block 38, the layer of sacrificial material 24 is initially processed by being etched back or planarized with the substrate 18 until they are planar with the sacrificial material 24 in the cavity 20, such that only a thin film 24*a* of the sacrificial material 24 remains on the substrate 18 along with the bulk of the sacrificial material 24 still occupying the cavity 20.

Following next, as per block 40 in FIG. 2, initially the heater substrata 22 is processed as desired. First, the heater or resistive layer 26 comprised of a first metal is deposited on the planarized layer of the sacrificial material 24 and the substrate 18. Next, the conductor layer 28, comprised by a second metal typically selected from a wide variety of conductive metals, is deposited on the first metal resistive layer 26 to complete the deposition of the layers of the first strata 12. After being deposited, they are patterned, masked and etched, in separate steps by conventional semiconductor processes, such as wet or dry etch techniques, into the general form shown in FIG. 2. In such manner, the etched first resistive metal layer 26 provides the fluid heater element 16 of the heater stack 10 and the etched second conductor metal layer 28 provides the power and ground leads 28*a*, 28*b* for the resistive heater element 16. The resistive and conductor layers 26, 28 may be selected from materials and may have thicknesses such as set forth in above cited U.S. Pat. No. 7,195,343.

Still referring to block 40, after the heater substrata 22 is processed, the layers making up the second strata 14 of the heater stack 10 are processed. As mentioned earlier, although shown as a single layer, these layers of the second strata 14 typically include distinct passivation and cavitation layers. The passivation layer is deposited over and directly on the resistive and conductor layers 26, 28 of the heater substrata 22 in order to protect them from fluid (ink) corrosion. The cavitation layer is then deposited on the passivation layer overlying the heater substrata 22. The passivation and cavitation layers of the second strata 14, also referred to as the heater overcoat in U.S. Pat. No. 7,195,343 may be selected from materials and may have thicknesses such as set forth in this patent. Once the passivation and cavitation layers are deposited, they are patterned, masked and etched, in separate steps by conventional semiconductor processes, such as wet or dry etch techniques, into the general form shown in FIG. 2.

Finally, as per block 42 in FIG. 2, once the first and second strata 12, 14 of the heater stack 10 are processed as desired, processing the sacrificial material 24 of the first strata 12 occurs by heating the substrate 18 to substantially remove or decompose the sacrificial material 24. The decomposition of the sacrificial material 24 results through a thermal process with or without oxygen by bringing the substrate 18 up to the thermal decomposition temperature of the sacrificial carbon material 24. This process turns the polymer (or other material) into ash with a minimal of residue remaining. Decomposition of the sacrificial material 24 may be aided with diffused oxygen from the substrate (SOG or other oxide). The decomposition products ($CO_2$ or other short carbon chain gases) diffuse into the substrate 18 over time, leaving the desired gas-filled cavity 20 in the substrate 18 below the heater element 16 of the heater substrata 22. It is expected that a very low percentage of residue of decomposed sacrificial material 24 is left in the cavity 20.

Referring now to FIG. 3, there is illustrated a second exemplary embodiment of a heater stack, generally designated 44, of a micro-fluid ejection device in accordance with the present invention. Overall, the structure of the heater stack 44 of FIG. 3 is similar to that of the heater stack 10 of FIG. 1. The heater stack 44 includes first (or heater forming) strata, generally designated 46, and second (or protective) strata, generally designated 48. The first strata 46 are configured to support and form the fluid heater element 50 in the heater stack 44 that is responsive to repetitive electrical activation and deactivation to produce repetitive cycles of fluid ejection from the ejection chamber 17. The second strata 48 overlie the first strata 46, are contiguous with the ejection chamber 17 above the second strata 48, and are configured to protect the heater element 50 from well-known adverse effects of the repetitive cycles of fluid ejection. However, in contrast to the first strata 12 of the heater stack 10 of the first exemplary embodiment of FIG. 1, the first strata 46 of the heater stack 44 has the cavity 52 located in a layer of photosensitive sacrificial material 54 disposed between the substrate 56 and the resistive layer 58 of the heater substrata 60.

Other than the difference in the location of the cavity 52, as mentioned above the heater stack 44 of the second exemplary embodiment is akin to the heater stack 10 of the first exemplary embodiment. The heater substrata 60, in addition to the resistive film or layer 58 overlying the sacrificial material 54, has the electrical conductor film or layer 62 partially overlying the resistive layer 58. The conductor layer 62 has a space 64 defined therein separating the conductor layer 62 into anode and cathode portions 62*a*, 62*b* which overlie corresponding spaced apart lateral portions 58*a*, 58*b* of the resistive layer 58. The latter are interconnected and separated by a central portion 58*c* of the resistive layer 58 deposed under and co-extensive with the space 64 of the conductor layer 62. The anode and cathode portions 62*a*, 62*b* of the conductor layer 62, being positive and negative terminals of ground and power leads electrically connected to a tab circuit (not shown), cooperate with the central portion 58*c* of the resistive layer 58 to form the fluid heater element 50 of the heater substrata 60 of the first strata 46. By way of example and not of limitation, the various layers of the first strata 46 can be made of the various materials and have the ranges of thicknesses as set forth in above cited U.S. Pat. No. 7,195,343.

The second strata 48 of the heater stack 44 overlie the first strata 46 and more particularly the heater substrata 60 of the first strata 46 to protect the resistive fluid heater element 50 from the well-known adverse effects of fluid forces generated by the repetitive cycles of fluid ejection from the ejection chamber 17 thereabove. Although only shown as a single layer in FIG. 3, the second strata 48 typically include at least two layers, a passivation (protective) layer and a cavitation (protective) layer. The function of the passivation layer is primarily to protect the resistive and conductor layers 58, 62 of the first strata 46 from fluid corrosion. The function of the cavitation layer is to provide protection to the fluid heater element 50 during fluid ejection operation which would cause mechanical damage to the heater stack 44 in the absence of the cavitation layer. By way of example and not of limitation, the various layers of the second strata 48 also can be made of the various materials and have the ranges of thicknesses as set forth in above cited U.S. Pat. No. 7,195,343.

Turning now to FIG. 4, there is illustrated a flow diagram with accompanying schematic representations, not to scale, of a second sequence of stages in making, or building the layers of, the second exemplary embodiment of the heater stack 44 of FIG. 3 in accordance with the method of the present invention. As per block 66, the substrate 56 in the first strata 46 is a base layer of silicon upon which the necessary logic and electrical connections have been processed and upon which all the other layers of the first and second strata 46, 48 will be deposited and patterned by using selected ones of conventional thin film integrated circuit processing techniques including layer growth, chemical vapor deposition, photo resist deposition, masking, developing, etching and the like. Next, as per block 68, the substrate 56 with the necessary electrical and logic connections is coated with a sacrificial photo-imagable photoresist material 54, for example a polymer treated with a photoacid. The thickness of the sacrificial layer, and thus the depth of the cavity 52, can be tuned in by selection of the application spin speed of coating the photoresist material 54. Next, as per block 70, the area in which the cavity 52 is to be defined and developed are exposed to UV energy through a mask 72. The area of polymer exposed is substantially the same as the area covered by the fluid heater element 50. Then, as per block 74, the heater substrata 60 is processed as desired. First, the heater or resistive layer 58 comprised of a first metal is deposited on the layer of the sacrificial material 54. Next, the conductor layer 62, comprised by a second metal typically selected from a wide variety of conductive metals, is deposited on the first metal resistive layer 58 to complete the deposition of the layers of the first strata 46. After being deposited, as per box 76, they are patterned, masked and etched, in separate steps by conventional semiconductor processes, such as wet or dry etch techniques, into the general form shown in FIG. 4. In such manner, the etched first resistive metal layer 58 provides the fluid heater element 50 of the heater stack 44 and the etched second conductor metal layer 62 provides the power and ground leads 62*a*, 62*b* for the resistive heater element 50. The resistive and conductor layers 58, 62 may be selected from materials and may have thicknesses such as set forth in above cited U.S. Pat. No. 7,195,343.

Next, as per block 78, after the heater substrata 60 is processed, the layers making up the second strata 48 of the heater stack 44 are processed. As mentioned earlier, although shown as a single layer, these layers of the second strata 48 typically include passivation and cavitation layers. The passivation layer is deposited over and directly on the resistive and conductor layers 58, 62 of the heater substrata 60 in order to protect them from fluid (ink) corrosion. The cavitation layer is then deposited on the passivation layer overlying the heater substrata 60. The passivation and cavitation layers of the second strata 48, also referred to as the heater overcoat in U.S. Pat. No. 7,195,343 may be selected from materials and may have thicknesses such as set forth in this patent. Once the passivation and cavitation layers are deposited, they are patterned, masked and etched, in separate steps by conventional semiconductor processes, such as wet or dry etch techniques, into the general form shown in FIG. 4.

Finally, still as per block 78 in FIG. 4, once the first and second strata 46, 48 of the heater stack 44 are processed as desired, processing the sacrificial material 54 of the first strata 46 occurs by heating the substrate 56 to substantially remove or decompose the sacrificial material 54. The decomposition of the sacrificial material 54 results through a thermal process with or without oxygen by bringing the substrate 56 up to the thermal decomposition temperature of the sacrificial material 54. One material that may be used at the sacrificial material 54 is a polycarbonate based polymer lightly doped with a photoacid. The activation of the photoacid lowers the decomposition temperature significantly, such as to the range of 100-180° C. The concentration of the photoacid can be modified to tailor the decomposition temperature. Other polymers/photoacid mixtures may be designed for use. For example, polyimide photoacid mixtures might be used. The decomposition products ($CO_2$ and other carbon based gases) diffuse into the substrate 56 over time, leaving the desired gas-filled cavity 52 in the substrate 56 below the heater element 50 of the heater substrata 60. It is expected that a very low percentage of residue of decomposed sacrificial material 54 is left in the cavity 52. As per block 79, the heater stack 45 (at the bottom) in FIG. 4 can be further oxidized to form a self-passivated heater element 51. Furthermore, if desired, once the heater stack of the device is formed, the polymer can be developed away from the non-heater regions of the device.

Referring now to FIG. 5, there is illustrated a flow diagram with accompanying schematic representations, not to scale, of a sequence of the stages, constituting modifications of, or additions to, certain ones of the stages of either the first or second sequences in FIG. 2 or 4, in making a third exemplary embodiment of a heater stack of a micro-fluid ejection device in accordance with the present invention. The schematic representations in FIG. 5 are plan views of the heater elements 16, 50 before and after decomposition of the sacrificial material 24, 54. As per block 80, the etching of the area of the substrate 18 to form the cavity 20 in FIG. 1 and the exposing of the layer of photoresist material 54 to define the cavity 52 are extended laterally of a pair of opposite sides 16*a*, 50*a* of the heater element 16, 50 so as to define slots 16*b*, 50*b* extending between the cavity 20, 52 and ejection chamber 17. After the heater substrata 22, 60 are processed, as per blocks 40, 76 of FIGS. 2 and 4, the sacrificial material 24, 54 defining the cavity 20, 52 and slots 16*b*, 50*b* is decomposed, as per block 82, so as to produce the cavity and slots to provide fluid communication between the ejection chamber 17 above the heater element 16, 50 and the cavity 20, 52 below the heater element 16, 50 such that the cavity is filled with the same fluid, such as ink, as is ejected from the ejection chamber 17 by the heater element 16, 50. These modifications or additions would be used when it is desirable to allow ink to encompass both the top and under sides of the heater element 16, 50 in order to transfer substantially all thermal energy to the ink. The modification to accomplish this is to initially pattern a larger area under the heater element to permit later creation of the slots 16*b*, 50*b* in order to obtain the flow of ink through them.

FIG. 6 illustrates a flow diagram with accompanying schematic representations, not to scale, of an additional sequence of stages in making a slight modification to the first exemplary embodiment of the heater stack of FIG. 1. As per block 84, the heater substrata 22 is processed to have a protective layer 86 on the underside of the resistive layer 26 and thus also on the underside of the heater element 16. As per block 88, after decomposition of the sacrificial material 24, the heater element 16 can then be sandwiched between the two protective layers 14, 86, as seen in FIG. 6. Protective layer 86 would protect the underside of the heater element 16 from prolonged contact with the ink. The slots 16*b* may be formed through the protective layer 86 also.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A heater stack for a micro-fluid ejection device, comprising:

first strata configured to support and form a fluid heater element responsive to repetitive electrical activation and deactivation to produce repetitive cycles of ejection of a fluid from an ejection chamber above said fluid heater element; and second strata overlying said first strata and contiguous with said ejection chamber to provide protection of said fluid heater element;

wherein said first strata includes a substrate having a front surface and a rear surface with a cavity extending into the substrate for a given depth from the front surface toward the rear surface, a heater substrata overlying said cavity and substrate, and a residual decomposed layer of sacrificial material in the cavity resulting from processing out of the cavity a sacrificial material thereby leaving said cavity substantially empty of said sacrificial material such that during repetitive electrical activation said cavity enables said fluid heater element to transfer heat energy into the fluid in said ejection chamber for producing ejection of the fluid therefrom substantially without transferring heat energy into said substrate.

2. The heater stack of claim 1 wherein said sacrificial material is an exposed and developed photo-imagable photoresist material.

3. The heater stack of claim 2 wherein said photo-imagable photoresist material is a photosensitive polymer treated with a photoacid.

4. The heater stack of claim 1 wherein said cavity is gas-filled.

5. The heater stack of claim 1 wherein said heater substrata and second strata overlying said heater substrata have slots formed along a pair of opposite lateral sides of said fluid heater element through said heater substrata and said second strata which provide fluid communication between said ejection chamber above said fluid heater element and said cavity below said fluid heater element permitting the fluid in said ejection chamber to flow between said ejection chamber and said cavity such that said cavity is filled with the same fluid as is ejected from said ejection chamber by said fluid heater element.

6. The heater stack of claim 5 wherein said heater substrata includes: a resistive layer overlying said cavity and substrate; and a conductive layer having an anode portion and a cathode portion separated from one another by a space and overlying and deposited on lateral portions of said resistive layer being interconnected and separated by a central portion of said resistive layer deposed under said space of said conductor layer so as to define said fluid heater element.

7. The heater stack of claim 6 wherein said heater substrata further includes a protective layer between said substrate and resistive layer so as to overlie said cavity and protect an underside of said fluid heater element from prolonged contact with the fluid in said cavity, said slots also being formed through said protective layer of said heater substrata.

8. The heater stack of claim 7 wherein said second strata includes a protective layer overlying said anode and cathode portions of said conductor layer and also overlying said central portion of said resistive layer defining said fluid heater element of said heater substrata, said slots also being formed through said protective layer of said second strata.

* * * * *